United States Patent [19]

Corsover et al.

[11] Patent Number: 4,533,278

[45] Date of Patent: Aug. 6, 1985

[54] EXPANSION JOINT SYSTEM

[76] Inventors: William L. Corsover, 561 Haskell Dr., Akron, Ohio 44313; Kenneth P. Hoffman, 5305 Northfield Rd., #229, Bedford Heights, Ohio 44146; William F. McCann, 3542 Glencairn Rd., Shaker Heights, Ohio 44122; Billy J. Wooden, 45 Hunting Trail, Moreland Hills, Ohio 44022

[21] Appl. No.: 516,509

[22] Filed: Jul. 25, 1983

[51] Int. Cl.[3] ..... E01C 11/10

[52] U.S. Cl. ..... 404/65; 404/69; 404/67; 52/98; 52/396

[58] Field of Search ..... 404/68, 69, 64, 65, 404/56–58, 66, 67, 47; 52/396, 403, 98, 100

[56] References Cited

U.S. PATENT DOCUMENTS

| | | | |
|---|---|---|---|
| 3,128,576 | 4/1964 | Bradley | 52/396 |
| 3,319,384 | 5/1967 | Berg | 52/100 |
| 3,394,639 | 7/1968 | Viehmann | 404/47 |
| 3,447,430 | 6/1969 | Gausepohl | 404/69 |
| 3,760,544 | 9/1973 | Hawes et al. | 52/403 X |
| 3,912,286 | 10/1975 | Kerschner | 404/68 X |
| 4,110,942 | 9/1978 | Slocomb, Jr. | 52/100 |
| 4,279,533 | 7/1981 | Peterson et al. | 404/68 |
| 4,359,847 | 11/1982 | Schukolinski | 404/68 X |

*Primary Examiner*—Stephen J. Novosad
*Assistant Examiner*—Beverly E. Hjorth

[57] ABSTRACT

An expansion joint system for functioning as an expansion joint between concrete sections of a roadway surface or the like. Such roadway surfaces are normally provided with a slot for accommodating thermal expansion and contraction of the concrete and a boxed-out zone for receiving the expansion joint system. The expansion joint system includes a plate and sealants. The plate is provided with a lower or interior resilient winged section inserted into the slot with wings extending exteriorly to frictionally engage the surfaces of the slot and thereby effect centering and preclude the raising of the plate from the slot. The plate is provided with an upper or exterior section including support surface for resting on the boxed-out surface of the cement segments to thereby preclude the plate from dropping into the slot. A stem couples the upper and lower sections of the plate. A sealant then covers the horizontal support and fills in the boxed-out zone of the concrete. The sealing includes a slab and nosings, the upper surfaces of which lie in a plane with the surface of the concrete sections whereby vehicular traffic or the like may move thereacross.

8 Claims, 2 Drawing Figures

EXPANSION JOINT SYSTEM

TECHNICAL FIELD

The subject matter of the present invention is an expansion joint system functioning for example as a roadway expansion joint, designed and constructed to enable adjacent concrete sections, separated by an expansion slot, to expand and contract without cracking while preventing water, debris or the like from entering the expansion slot and while maintaining a durable, smooth continuation of the surface sections being joined by the expansion joint system.

BACKGROUND OF THE INVENTION

Concrete roadways are normally made from concrete sections, each section being separated from its next adjacent section by an expansion slot. These expansion slots are utilized to enable thermal expansion and contraction of the roadway at the slot. This precludes cracking of the concrete when subjected to stress and strain created by fluctuations in thermal conditions.

In certain roadway surfaces these expansion slots can simply be filled with appropriate materials which will resile during thermal expansion and contraction and which will constitute a smooth transition from one concrete section to another by vehicular traffic. However, for concrete to concrete interfaces in other applications such as parking decks, ramps, stadiums, bridges, pedestrian walkways or the like other more complex systems must be utilized in an effort to effectively and durably fill and seal such slots while still accommodating the expansion and contraction of the concrete.

Numerous configurations of preformed rubber, elastomeric or metal members or combinations thereof have been manufactured to various shapes and designs for use in filling in the space between concrete slabs. The principal difficulty with all such prior art structures is that they lack durability over time and can, after a short period of time, cease to provide the effective joint which permits adjacent concrete slabs to expand and contract under varying conditions of temperature to preclude cracking of the concrete. Deterioriation and failure of the joint structure can also result in a space between the concrete slabs rendering a discontinuity between adjacent concrete slabs. This would result in the inconvenience and discomfort of vehicular traffic thereover. Further, all such prior art expansion joint systems are relatively costly and require excessively time consuming installation procedures.

Among the prior art devices used as expansion joint systems are those described in U.S. Pat. No. 4,279,533 to Peterson et al and U.S. Pat. No. 3,722,379 to Koester. In each of those systems, however, the performance is inferior as compared with the system of the present invention. Also, the costs of materials and installation time in prior art devices are relatively high as compared with the system of the present invention. In summary, the system of the present invention increases life, durability and performance while decreasing costs as compared with all other known expansion joint systems.

SUMMARY OF THE INVENTION

In accordanace with the present invention, a rigid plastic plate is utilized to span the slot between adjacent concrete sections of a roadway or the like. The plate is provided with a vertical stem, the lower portion of which terminates on flexible wings oriented in a broad V-shaped configuration for mechanically securing itself to the opposed vertical surfaces of the concrete slot. The principal benefit, however, derived from the design of the wings is the centering of the plate which remains centered in the system even during the expansion and contraction of the concrete during varying conditions of temperature. The system would function inefficiently if the plate were to shift side to side as during expansion and contraction of the slabs. The upper end of the stem terminates in an upper horizontal support, the opposed surfaces of which rest on the boxed-out zone of the concrete sections to be bridged by the expansion joint system. Filling out the rest of the boxed-out zone of the concrete sections is a sealant formed of a slab and nosings. The slab may be either premolded or poured in place. This sealant slab is preferably formed of an elastomeric sealant which will fill in the majority of the boxed-out zone above the plate. On each side of the sealant slab are the nosings constructed of a relatively hard elastomeric material to complete the horizontal surface between the concrete sections and the sealant slab. The sealant slab and nosings together form a horizontal surface parallel with the upper surface of the concrete sections to be coupled by the expansion joint system of the present invention. The horizontal support surfaces of the plate provide the majority of the support for the movement of vehicular or pedestrian traffic across the expansion joint system.

It is, therefore, an object of the present invention to span a thermal expansion slot between concrete sections of a roadway or the like with a system which is effective, durable, inexpensive and easy to install, even over a wide variety of weather and climatic conditions.

In order to gain a better understanding of the instant invention as well as other advantages and further features thereof, reference is made to the following detailed description of the invention to be read in conjunction with the accompanying drawings and appended claims forming part of this patent application.

DESCRIPTION OF THE PREFERRED EMBODIMENT

Figure 1:
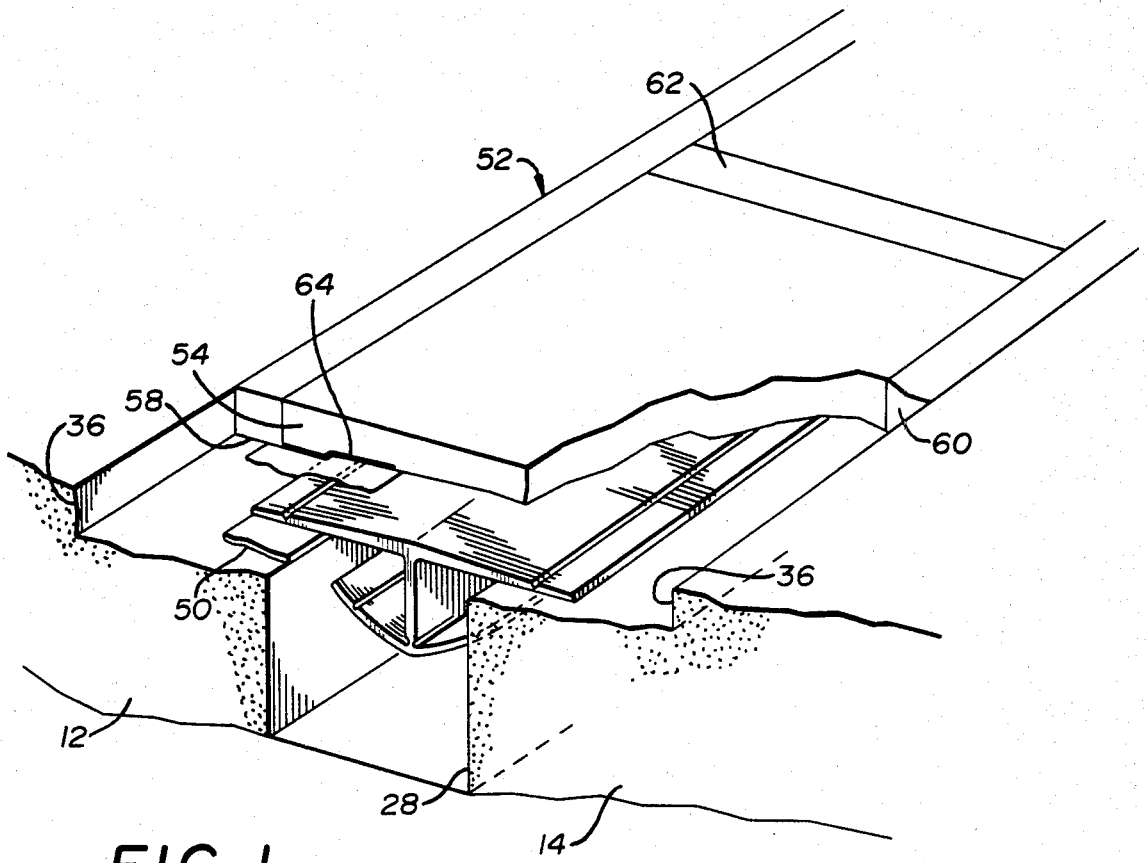
FIG. 1 shows a fragmentary isometric view of the expansion joint system of the present invention with parts broken away to show internal construction thereof.

Referring now to the drawings, there is shown in FIG. 1, a plate 10 installed between adjacent concrete sections 12 and 14 to be joined by the expansion joint system of the present invention. The plate itself can be more readily seen with reference to FIG. 2. The plate includes a vertical stem portion 16 coupling the lower wing portions 18 and 20 and upper planar or horizontal support 22 formed of surfaces 24 and 26.

The entire plate is preferably extruded, or in the alternative molded, of a rigid, plastic compound such as polyvinyl chloride, PVC. Additional suitable plastics may include chlorinated polyvinyl chloride, CPVC, and acrylonitrile-butadiene-styrene, ABS. Also, materials such as thermoplastic elastomers, TPE, may be employed. Such materials also have the advantage of having non-bonding, release properties to preclude adhering to a slab when poured in place thereover. This is important to permit movement therebetween when expansion or contraction occurs while in use. The plates are normally cut in sections up to 5 foot in length. Shorter or longer sections, however, can be extruded or otherwise fabricated depending on the particular configuration of the concrete sections to be joined. A typical polyvinyl chloride material which could be utilized would be Geon ® plastic such as Geon 8700A manufactured by, and commercially available from, The B.F.Goodrich Company. The selection of this material is such as to be strong, inexpensive and resistant to the electrolytic action which might otherwise occur due to the environmental conditions and location in which this system is intended to be employed.

Figure 2:
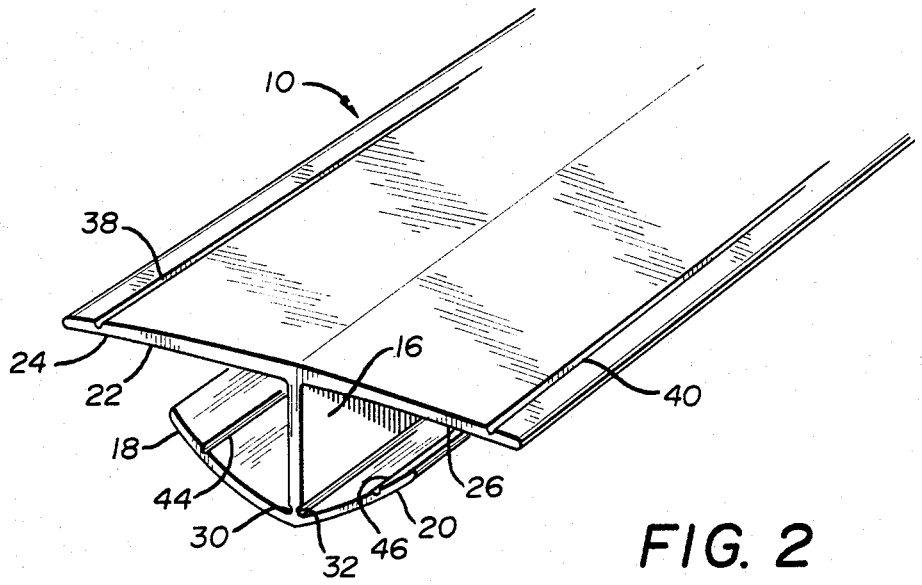
FIG. 2 is a fragmentary isometric view of the plate of FIG. 1 but with the wings in a relaxed condition.

The wings 18 and 20 are formed in a V-shaped configuration but a broad V-shape approaching the horizontal as seen in FIG. 2. In this manner, the wings of the plate may be inserted into the slot 28 between the concrete sections whereupon they will bend upwardly into a more acute V-shape as shown in FIG. 1. Friction support is created by the tips of the wings against the concrete vertical walls of the concrete sections which constitute the slot. This bending action of the wings with their normal resilience to return to their normal broader configuration will generate a mechanical holding action whereby the plate will remain centered during movement of the concrete slabs during expansion and contraction. The resilience will also permit the plate to resist being lifted out of the slot during normal use. Slots or channels 30 and 32 are preferably formed on the stem adjacent the wings to assist in the flexing of the wings during insertion and use.

The upper extent of the stem supports the planar, upper or horizontal support 22 which is symetrically formed to extend outwardly from both sides about the stem. The horizontal support surfaces are adapted to rest on the boxed-out zone 36 of the concrete during use. Boxed out zones of this nature are normally provided when concrete roadways or the like are initially constructed to accommodate expansion joint systems. The boxed-out zone extends the entire width of the concrete roadway which may be several yards in length. In other applications such as airport runways the boxed-out zone may extend to over a mile in length. These horizontal support surfaces of the plate provide the bulk of the support for the vehicular traffic moving across the expansion joint system from one concrete section to another.

It should be understood that expansion joint systems as described in the present application have utility in a wide range of fields beyond roadways and airstrips which are normally horizontal. Other applications, horizontal and otherwise, are readily envisioned for incorporating the present expansion joint system such as bridges, dams, walls, stadiums, tunnels, and the like.

It is preferred to form the horizontal or planar support as shown in the figures with the greater accumulation of material adjacent the center along the stem then at its edges. This is for increased strength of the horizontal support at the center of the plate where the load to be supported is the greatest. The lower surfaces of the horizontal support surfaces are to rest upon, and to be supported by, the concrete to preclude dropping of the plate into the slot.

Formed into the horizontal support surfaces are slots or channels 38 and 40. The purpose of these slots is to permit the easy breaking off of the ends from the main portion of the plate so that the plate may be used in smaller environments such as with smaller boxed-out zones and smaller slots. Similarly, slots or channels 44 and 46 are provided on the wings for being broken off from the main portion of the plate depending on the size of the slot to be spanned by the system.

Normally the slot 28 may be one to four inches across with the boxed-out zone of the concrete being eight to ten inches across and cut to the depth of $\frac{3}{4}$ inches.

Also shown in FIG. 1 is an additional member which may or may not be utilized depending on the orientation of the concrete. This element is a leveling strip 50 formed of a compound which would be required in the event that one section of the concrete is higher than the next adjacent section. In such case, the lower segment should be built up with an elastomeric sealant such as Traffic Joint Leveling Compound material commercially available from the Tremco Company, Inc. This compound is a gel-like, fast-setting, two-part elastomeric sealant which sets up in less than 60 minutes. This quick setting material allows a mechanic to quickly and accurately level a joint and continue the installation of the instant system with negligible lost time.

The remainder of the boxed-out zone between the concrete sections above the slot 28 is then provided with sealant 52 above the plate 10 in the form of a sealant slab 54 and nosings 58 and 60. The sealant slab may be poured in place or premolded of an elastomeric sealant such as that sold by the Tremco Company, Inc. under the trade name THC 900. It is preferably formulated of a polyurethane, polysulfide or the like as its principal constituent. This material is durable and readily expands and contracts over a wide range of thermal and other atmospheric conditions, rendering it well-suited for use in the present inventive expansion joint system.

At opposite ends of the sealant slab 54, to couple the sealant slab to the concrete, are the nosings 58 and 60 which are poured on site. They are preferably formulated of a relatively hard and durable elastomeric material, preferably of material commercially available under the tradename of Polyweld 100 sold by the Tremco Company, Inc. Such material has a durometer Shore A hardness of about 96 or greater. Typical materials for such applications are rubberized epoxies, multicomponent polyurethanes, sand-filled epoxies or the like. These are extremely hard and durable elastomeric materials which will endure the wear of vehicular traffic and also assist in permanently bonding itself to both the concrete and to the sealant slab through a chemical interaction.

Materials having similar properties may likewise be used as the sealant slab. Such materials should be capable of expanding up to plus or minus 25% during use under varying temperatures. They should remain flexible below −60° Fahrenheit. They should have a modulus of at least 25–30 pounds at 100% elongation. Also, as will be understood by those skilled in the art, additional ingredients may be added to the slab material such as carbon black for a filler, curing agents, age resistors, etc., as is well known in the art.

In the fabrication of the expansion joint system of the present invention, the sealant slab can be molded in a factory. It may then be brought to the final site and applied, centrally positioned on the plate in the boxed-out zone of the concrete. Thereafter, the nosings will be poured in place to complete the system. In such case, splice joints 62 must be utilized periodically along the length of the preformed sealant slabs to insure the smooth exterior or upper surface of the joint across the width of the sealant slab and concrete sections. A typical spliced joint could be made of Polyweld 200 splice joint compound commercially available from the Tremco Company, Inc. and would be constructed from the class of materials similar to, but less rigid than, that utilized in the nosings. Such material has a durometer Shore A hardness of 60, plus or minus 5%.

In the event that the sealant slab is to be poured in place, the preferred application technique would be to utilize a board of metal or wood as a preform. The preform would be of the size of the sealant slab and be positioned over the slot but leaving space for the pouring of the nosings adjacent the boxed-out zones contiguous to the concrete. To preclude adhesion of the nosing to the preform, the edges of the preform, corresponding to the contact point with the nosings, should be coated with an adhesive material. The nosings may then be poured in place to the proper height corresponding to the height of the roadway surfaces. After the setting of the nosings, the preform is removed.

Prior to the pouring of the sealant slab, the plate must be installed. Then a tape 64 should be applied to the exposed concrete and over the edges of the plate. Tape suitable for this purpose would be a commercially available bond breaker tape. This tape is formed with an adhesive surface to thereby adhere to the concrete and plate. The opposite surface of the tape is of an abhesive surface to preclude the adherance of the sealant slab thereto. This permits proper expansion and contraction of the slab with respect to the concrete to which it would otherwise adhere to severely limit expansion and contraction. Thereafter the vertical nosing surfaces may be primed and then the sealant slab poured in place to the proper height to fill the space where the preform had been. It is poured to a height parallel with the nosings and exterior surface of the concrete sections of the roadway. The material selected for the slab is preferably self leveling to thereby effect an efficient expansion joint.

The adhesion between the sealant slab and nosings is chemical in nature. Therefore, there is no requirement for sand blasting of these parts prior to their pouring as would be otherwise required in prior art systems to create a mechanical bond of similar components. The adhesion between the nosings and concrete is a combination of mechanical and chemical bonding. Typical concrete finishes are adequate for the use of Polyweld 100. However, hard, glossy concrete finishes would require a light abrasion. Superior adhesion is created by the present selection of materials. Further, because of the nature of the selected materials, installation of the nosings may be carried out in marginal weather including rain, thus precluding rain delays in the installation of such systems. It is preferred, however, so as to enhance adhesion, that the concrete edges to be contacted by the nosings be cleaned, as for example, with xylol, toluol or the like.

The resulting expansion joint system of the present invention will thus yield a system which is more durable than any prior art structure, operable over a wider variety of climatic conditions including wide temperature variations and can be installed more quickly and inexpensively than prior systems.

It will be understood that while the invention has been described in its particulars with reference to the preferred embodiment or best known mode for carrying out the invention, various changes and modifications may be made, all within the spirit and scope of the appended claims.

What is claimed is:

1. An expansion joint system for coupling concrete segments having a slot and a boxed-out zone therebetween, such system comprising:

a plastic plate having resilient means, a support surface and a stem therebetween, said resilient means being positioned in the slot and extending outwardly in gripping contact with walls of the slot, and support surfaces having lower faces supported by the boxed-out zone and spanning the slot the plate being unattached to the segments, a sealant slab positioned in the boxed-out zone to cover the plate and a part of the concrete with an exterior surface substantially parallel with exterior surfaces of the concrete segments, and nosings positioned to essentially fill between edge portions of the sealant slab and end concrete portion of the boxed-out zone, having exterior surfaces substantially parallel with exterior surfaces of the concrete segments and sealant slab.

2. The expansion joint system as set forth in claim 1 wherein said sealant slab is formed of a self leveling elastomer.

3. The expansion joint system as set forth in claim 1 wherein said plate is formed of polyvinyl chloride.

4. The expansion joint system as set forth in claim 1 wherein said nosings are formed of an elastomer harder than the sealant slab.

5. The expansion joint system as set forth in claim 1 wherein said resilient means is formed of wings extending toward said support surface.

6. An expansion joint system for coupling concrete segments having a slot and a boxed-out zone therebetween, such system comprising:

a plate formed of a polyvinyl chloride material and having resilient wings, a support surface and a stem therebetween, said wings being positioned in the slot and extending generally toward said support surface and outwardly into gripping contact with walls of the slot, said support surfaces having lower faces supported by the surface of the boxed-out zone and spanning the slot the plate being unattached to the segments, a sealant slab formed of a self leveling elastomer and positioned in the boxed-out zone to cover the plate and a part of the concrete of the boxed-out zone with an exterior surface substantially parallel with exterior surfaces of the concrete segments, and nosings formed of an elastomer harder than said sealant slab and positioned to essentially fill between edge portions of the sealant slab and end concrete portions of the boxed-out zone, having exterior surfaces substantially parallel with exterior surfaces of the concrete segments and sealant slab.

7. The expansion joint system as set forth in claim 6 and further including slots in said support surface and said wings to facilitate the removal of portions thereof to reduce their sizes.

8. The expansion joint system as set forth in claim 6 and further including slots in said stem adjacent said wings to facilitate the resilience of said wings.

* * * * *

UNITED STATES PATENT AND TRADEMARK OFFICE

CERTIFICATE OF CORRECTION

PATENT NO. : 4,533,278

DATED : August 6, 1985

INVENTOR(S) : WILLIAM L. CORSOVER, KENNETH P. HOFFMAN, WILLIAM F. MCCANN, BILLY J. WOODEN

It is certified that error appears in the above-identified patent and that said Letters Patent are hereby corrected as shown below:

On the Title page,

After (76) Inventors: add the following:

--Assignee: Tremco Incorporated
10701 Shaker Blvd.
Cleveland, Ohio 44104--

After Assistant Examiner-Beverly E. Hjorth add the following:

--Attorney or Agent Joseph Januszkiewicz
Woodrow W. Ban--

Signed and Sealed this

Twenty-eighth Day of October, 1986

[SEAL]

*Attest:*

DONALD J. QUIGG

*Attesting Officer*

*Commissioner of Patents and Trademarks*